United States Patent [19]

Tokuyama et al.

[11] Patent Number: 5,027,762

[45] Date of Patent: Jul. 2, 1991

[54] LUBRICATION SYSTEM FOR MULTI-CYLINDER ENGINE

[75] Inventors: Masakazu Tokuyama; Masashi Taniguchi, both of Hiroshima, Japan

[73] Assignee: Mazda Motor Corporation, Hiroshima, Japan

[21] Appl. No.: 559,940

[22] Filed: Jul. 30, 1990

[30] Foreign Application Priority Data

Jul. 29, 1989 [JP] Japan ..... 1-89443[U]

[51] Int. Cl.[5] ..... F01M 9/10

[52] U.S. Cl. ..... 123/90.34; 123/196 M

[58] Field of Search ..... 123/90.33, 90.34, 196 M

[56] References Cited

U.S. PATENT DOCUMENTS

| | | | |
|---|---|---|---|
| 4,441,465 | 4/1984 | Nakamura | 123/90.34 |
| 4,621,597 | 11/1986 | Kawada et al. | 123/90.34 |
| 4,709,667 | 12/1987 | Ichihara et al. | 123/90.34 |
| 4,729,349 | 3/1988 | Sonoda et al. | 123/90.34 |
| 4,807,574 | 2/1989 | Shibata et al. | 123/90.34 |
| 4,858,574 | 8/1989 | Fukuo et al. | 123/90.34 |
| 4,881,497 | 11/1989 | Matayoshi et al. | 123/90.34 |
| 4,915,066 | 4/1990 | Koshimoto et al. | 123/90.34 |
| 4,942,855 | 7/1990 | Muto | 123/90.33 |

FOREIGN PATENT DOCUMENTS

| | | | |
|---|---|---|---|
| 575263 | 5/1959 | Canada | 123/90.33 |
| 59-107011 | 7/1984 | Japan . | |

*Primary Examiner*—David A. Okonsky
*Assistant Examiner*—Weilun Lo
*Attorney, Agent, or Firm*—Fleit, Jacobson, Cohn, Price, Holman & Stern

[57] ABSTRACT

A lubrication system for a multi-cylinder internal combustion engine has a valve drive mechanism equipped with a row of hydraulic valve lash adjusters installed in a cylinder head of an engine block of the engine and a camshaft with journals which is disposed over the cylinder head and is attached, at one end thereof, with a camshaft pulley coupled to a crankshaft pulley by a belt. The lubrication system includes a main oil gallery extending lengthwise in the engine body, a lash adjuster oil gallery formed in the cylinder head and extending along the row of hydraylic valve lash adjusters, and a camshaft oil gallery formed in the cylinder head and extending parallel to the lash adjuster oil gallery. The main oil gallery is connected independently to one end of the camshaft oil gallery adjacent the camshaft pulley and to one end of the lash adjuster oil gallery remote from the camshaft pulley so as to supply them with pressurized oil, fed by an oil pump, in opposite direction. The pressurized oil is carried, on one hand, to each camshaft journal through the camshaft oil gallery and, on the other hand, into a pressure chamber of each hydraylic valve lash adjuster through the lash adjuster oil gallery.

9 Claims, 7 Drawing Sheets

LUBRICATION SYSTEM FOR MULTI-CYLINDER ENGINE

FIELD OF THE INVENTION

The present invention relates to an automobile engine lubrication system, and more particularly, to a lubrication system for a multi-cylinder internal combustion engine having a valve drive mechanism equipped with hydraulic valve lash adjusters.

BACKGROUND OF THE INVENTION

Typically, a multi-cylinder internal combustion engine of this type has a valve drive mechanism equipped with as many hydraulic valve lash adjusters as there are valves in the engine. To lubricate the hydraulic valve lash adjusters, a cylinder head of the engine, in which the hydraulic valve lash adjusters are located, is formed with a lubrication oil passageway or gallery in a wall thereof. Lubrication oil is generally introduced into a main oil passageway or gallery first, and then into a lubrication oil passageway or gallery for lubricating camshaft journals. After having lubricated the camshaft journals, the lubrication oil enters the valve lash adjuster lubrication oil gallery. Such a lubrication system is known from, for instance, Japanese Unexamined Utility Model Publication No. 59(1984)-107011.

In such a lubrication system in which lubrication oil is introduced into the lash adjuster lubrication oil gallery after having lubricated the camshaft journals, since the lubrication oil escapes or leaks past the camshaft journals, it is generally hard to maintain the lubrication oil at a sufficient oil pressure in the lash adjuster lubrication oil gallery. A reduction or drop in pressure occurs, in particular, at the valve lash adjuster or valve lash adjusters located on the downstream side of the lash adjuster lubrication oil gallery. This pressure drop allows air contamination of the lubricating oil in pressure chambers of the lash adjusters, so that the valve lash adjusters produce noise or encounter unstable operation.

For the purpose of preventing the lash adjuster from being subjected to a pressure drop, the above-described prior art lubrication system has been improved by providing a bypass oil passageway or gallery which connects the main oil gallery to an oil hole for the hydraulic valve lash adjuster and has a diaphragm and a valve, both disposed in the bypass passageway, so that when a reduction or drop in pressure occurs at the oil hole, the valve is forced to open in order to develop a sufficient oil pressure for the valve lash adjuster. This lubrication method is, however, apt to result in structurally complex lubrication system.

To eliminate adverse effects of the escape of lubrication oil at the camshaft journals to the hydraulic valve lash adjusters, the lubrication system could be organized by independently connecting a camshaft journal lubrication oil gallery and a valve lash adjuster lubrication oil gallery to a main oil gallery by way of separate lubrication oil passageways. However, because the lubrication oil escapes at the camshaft journals, even with the separation of the connecting oil passageways, it is still hard to provide the hydraulic valve lash adjusters with an oil pressure sufficient to eliminate adverse effects.

SUMMARY OF THE INVENTION

It is, therefore, a primary object of the invention to provide a lubrication system for a multi-cylinder internal combustion engine which can reduce the escape of lubrication oil from camshaft journals so as to provide hydraulic valve lash adjusters with sufficient oil pressure to keep the lash adjusters operating properly.

It is another object of the present invention to provide a lubrication system for a multi-cylinder internal combustion engine which applies a sufficient pressure of lubrication oil at a camshaft journal or camshaft journals, located close to a camshaft pulley, which are subjected to a particular load which is substantially higher than the load applied to each remaining camshaft journal.

It is still another object of the present invention to provide a lubrication system for a multi-cylinder internal combustion engine having a cylinder head of an engine body, and in particular, a wall section of the cylinder head in which hydraulic valve lash adjusters are located or installed, with improved structural rigidity.

The objects of the present invention are achieved by producing a lubrication system for a multi-cylinder internal combustion engine having a valve drive mechanism equipped with a row of hydraulic valve lash adjusters installed in a cylinder head of an engine body of the engine and a camshaft with journals which is disposed over the cylinder head and is attached, at one end thereof, with a camshaft pulley coupled to a crankshaft pulley by a belt. The lubrication system is constituted by a main oil gallery extending lengthwise in the engine body, a lash adjuster oil gallery formed in the cylinder head and extending along the row of hydraulic valve lash adjusters, and a camshaft oil gallery formed in the cylinder head and extending in parallel to the lash adjuster oil gallery.

The main oil gallery is connected independently to one end of the camshaft oil gallery adjacent the camshaft pulley and to one end of the lash adjuster oil gallery remote from the camshaft pulley so as to supply them with pressurized oil, fed by an oil pump, in opposite directions. The pressurized oil is carried, on one hand, to each camshaft journal through the camshaft oil gallery and, on the other hand, into a pressure chamber of each hydraulic valve lash adjuster through the lash adjuster oil gallery.

The main gallery of the lubrication system is provided with pressure regulating means, such as an orifice, disposed before the camshaft journal oil gallery for regulating the pressure of oil in the camshaft journal oil gallery so as to maintain a stable oil pressure at each hydraulic valve lash adjuster.

BRIEF DESCRIPTION OF THE DRAWINGS

The above and other objects and features of the present invention will be apparent from the following description of a preferred embodiment when considered in conjunction with the accompanying drawings, in which.

DESCRIPTION OF THE PREFERRED EMBODIMENTS

Figure 1:
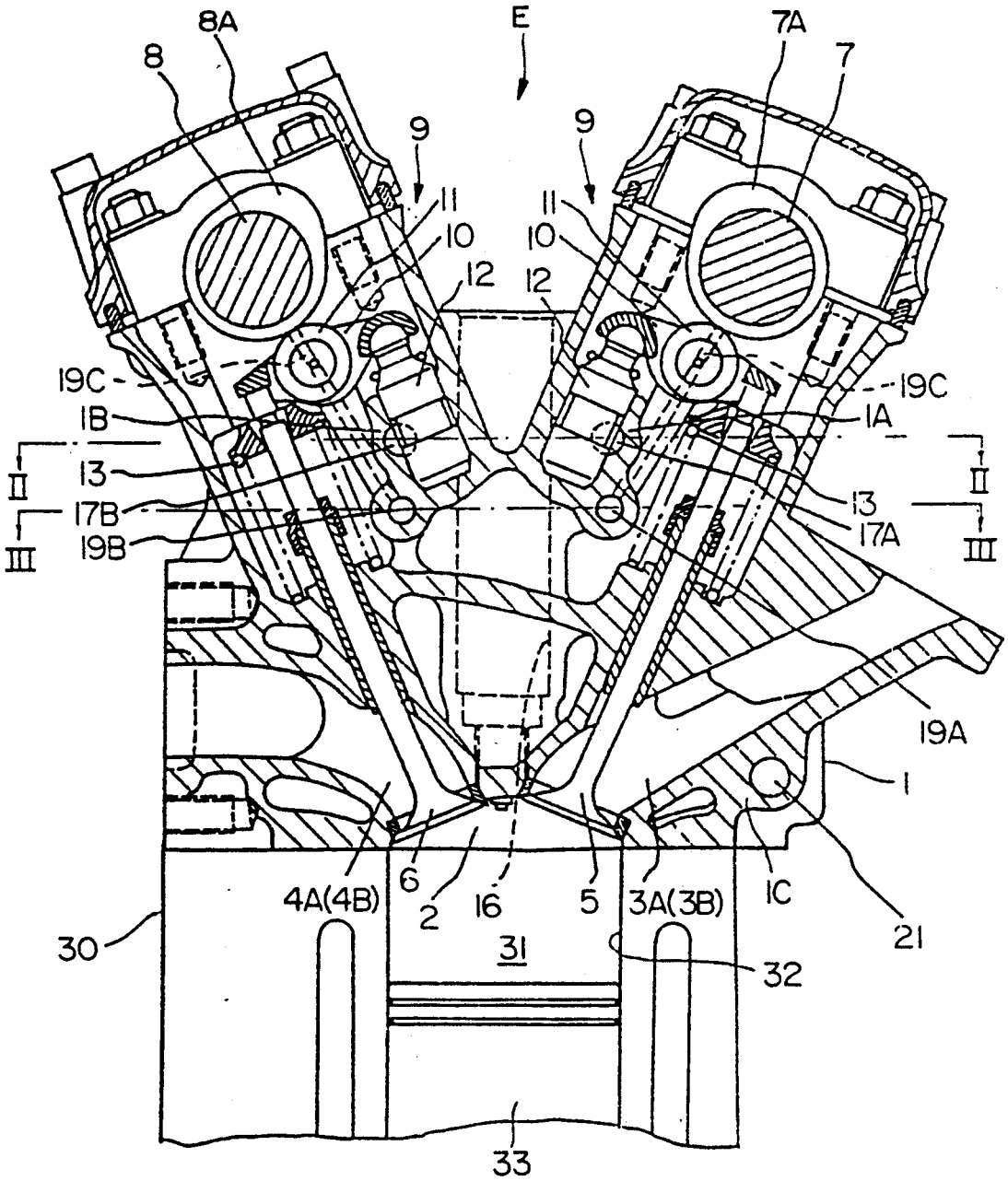
FIG. 1 is a schematic cross-sectional view showing an in-line six cylinder internal combustion engine with a lubrication system according to a preferred embodiment of the present invention.
Figure 2:
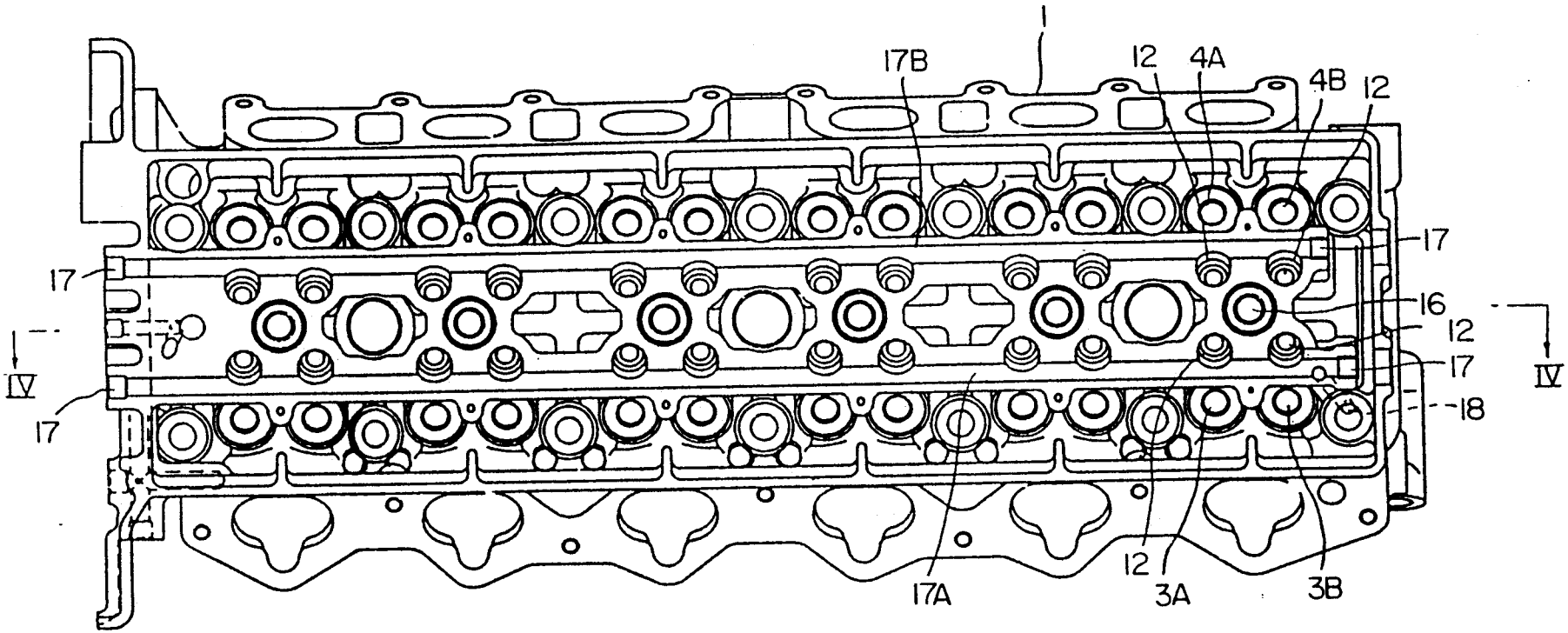
FIG. 2 is a cross-sectional view of FIG. 1 as seen along line II—II.

Referring to the drawings in detail, in particular to FIG. 1, a cylinder head of an engine body of an in-line 6 cylinder, double overhead camshaft engine having a lubrication system in accordance with a preferred embodiment of the present invention is shown. The engine body E consists of a cylinder block 30 formed with six cylinders 31 arranged in a straight line and a cylinder head 1 mounted on the cylinder block 30. The cylinders 31 are disposed in the cylinder head 1 so that adjoining cylinders do not fire one after another. The cylinder head 1 is provided with two intake ports 3A and 3B for each cylinder 30 with openings which extend laterally upward. Further, the cylinder head 1 is provided with two exhaust ports 4A and 4B for each cylinder 30 with openings which extend laterally toward one side of the cylinder head 1 remote from the intake port 3. Combustion chambers 2 are formed in the cylinders, respectively, by the tops of pistons 33 received in the cylinders 31, a lower wall of the cylinder head 1 and cylinder bores 32. The intake ports 3A and 3B and the exhaust ports 4A and 4B open into each combustion chamber 2, and are opened and shut at a predetermined timing by intake valves 5 and exhaust valves 6, respectively. These intake valves 5 and exhaust valves 6 are usually forced to close the intake port 3A (3B) and the exhaust port 4A (4B), respectively, through the aid of valve springs 13, and are driven by a valve drive apparatus 9, described in detail later, to open and shut the intake and exhaust ports 3A (3B) and 4A (4B).

An intake camshaft 7 and an exhaust camshaft 8 are mounted on and arranged in juxtaposition over the cylinder head 1. The intake camshaft 7 is provided with one cam or camshaft lobe 7A thereon for each intake valve 5 and has an end portion projecting out of the cylinder head 1. Similarly, the exhaust camshaft 8 is provided with one cam or camshaft lobe 8A thereon for each exhaust valve 6 and has an end portion projecting out of the cylinder head 1. Pulleys 22 and 23 (see FIG. 5) are coaxially fixed on the ends of the parts of the intake and exhaust camshafts 7 and 8 projecting from the cylinder head 1. These pulleys 22 and 23 are connected or coupled to a crankshaft (not shown) by a timing belt or chain (not shown) which transmits the engine output to drive the camshafts 7 and 8 in synchronism in the same direction.

The valve drive apparatus 9 includes as many rocker arms 10 as the intake and exhaust valves 5 and 6, each rotatably mounting a roller 11 at the intermediate portion thereof. That is, the rocker arms 10 are arranged in two straight rows parallel to the row of the cylinders 31. The two rows of the rocker arms 10 are arranged between the rows of the intake and exhaust valves 5 and 6 or on opposite sides of a row of plug holes 16 each of which receives therein an ignition plug (not shown) for each cylinder 31. The valve drive apparatus 9 further includes hydraulic lash adjusters 12. One hydraulic lash adjuster is provided for each of the rocker arms 10, and is partially embedded or installed in middle wall sections 1A and 1B of the cylinder head 1. The rocker arm 10 is located so that the roller 11 is maintained in contact with the camshaft lobe 7A or 8A and is supported by the top end of the valve stem of the intake or exhaust valve 5 or 6 at one end and a pivoting end of the plunger of the valve lash adjuster 12 at its opposite end. The rocker arm 10 is operated by the camshaft lobe 7A or 8A rubbing on, i.e., engaging directly, the roller 11 of the rocker arm 10. The lash adjuster 12 always maintains zero clearance between the valve stem and the rocker arm. It is to be noted that the valve driving apparatus 9 itself, as well as the rocker arm 10 and the hydraulic lash adjuster 12, is well known in structure and function to those skilled in the art and can be of any known type.

Figure 3:
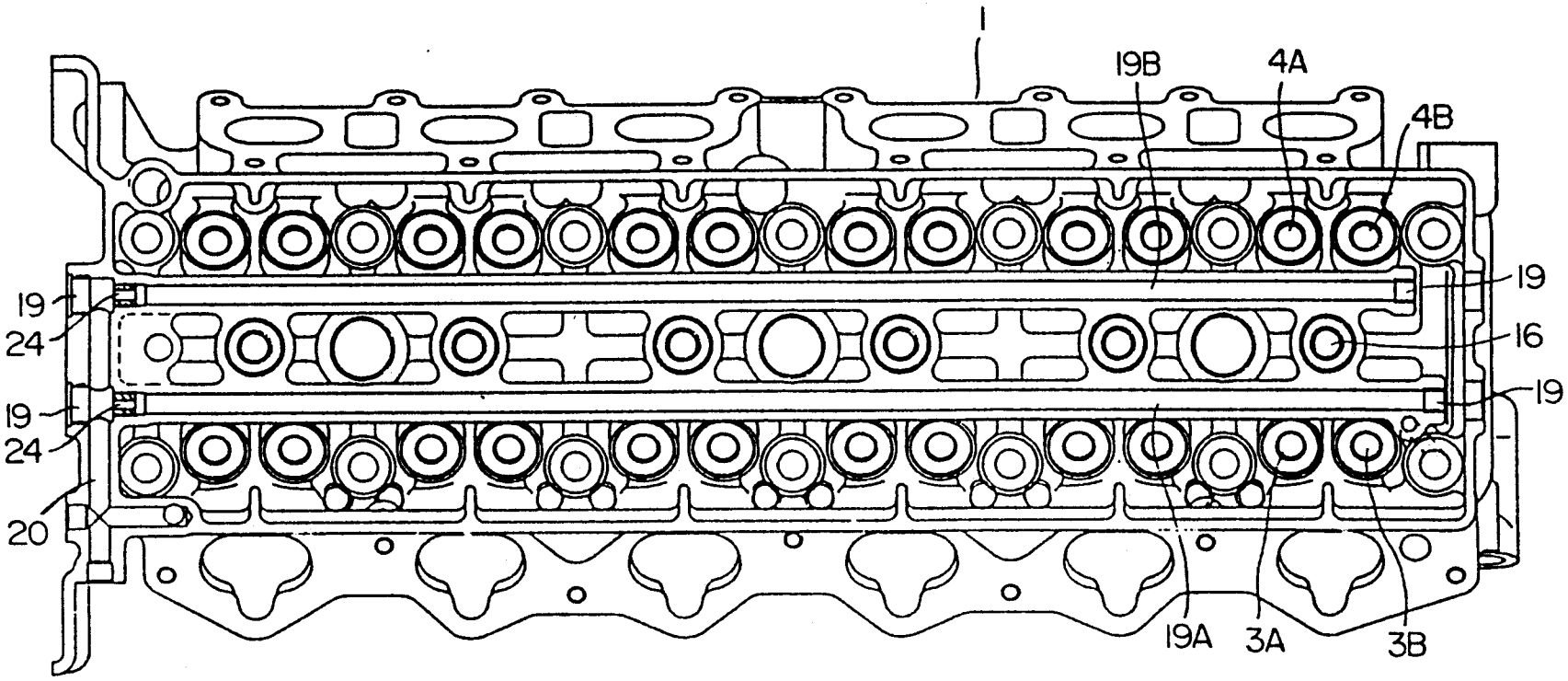
FIG. 3 is a cross-sectional view of FIG. 1 as seen along line III—III.
Figure 4:
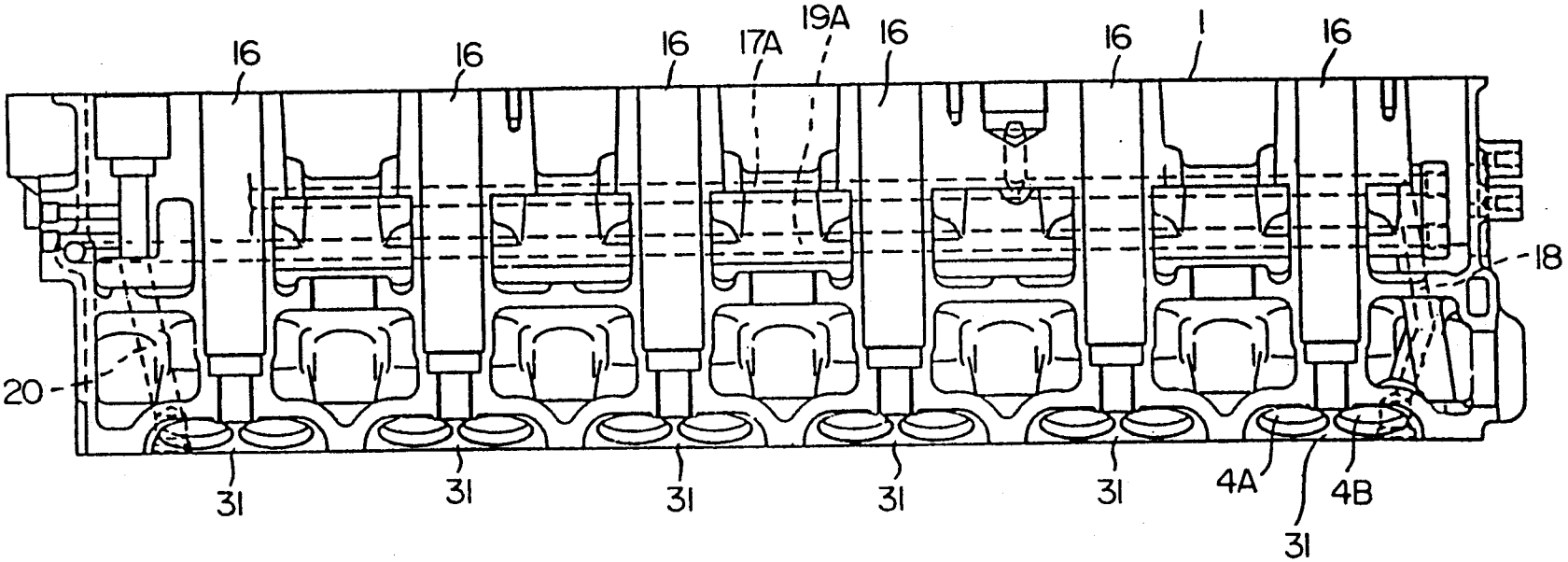
FIG. 4 is a cross-sectional view of FIG. 3 as seen along line IV—IV.
Figure 5:
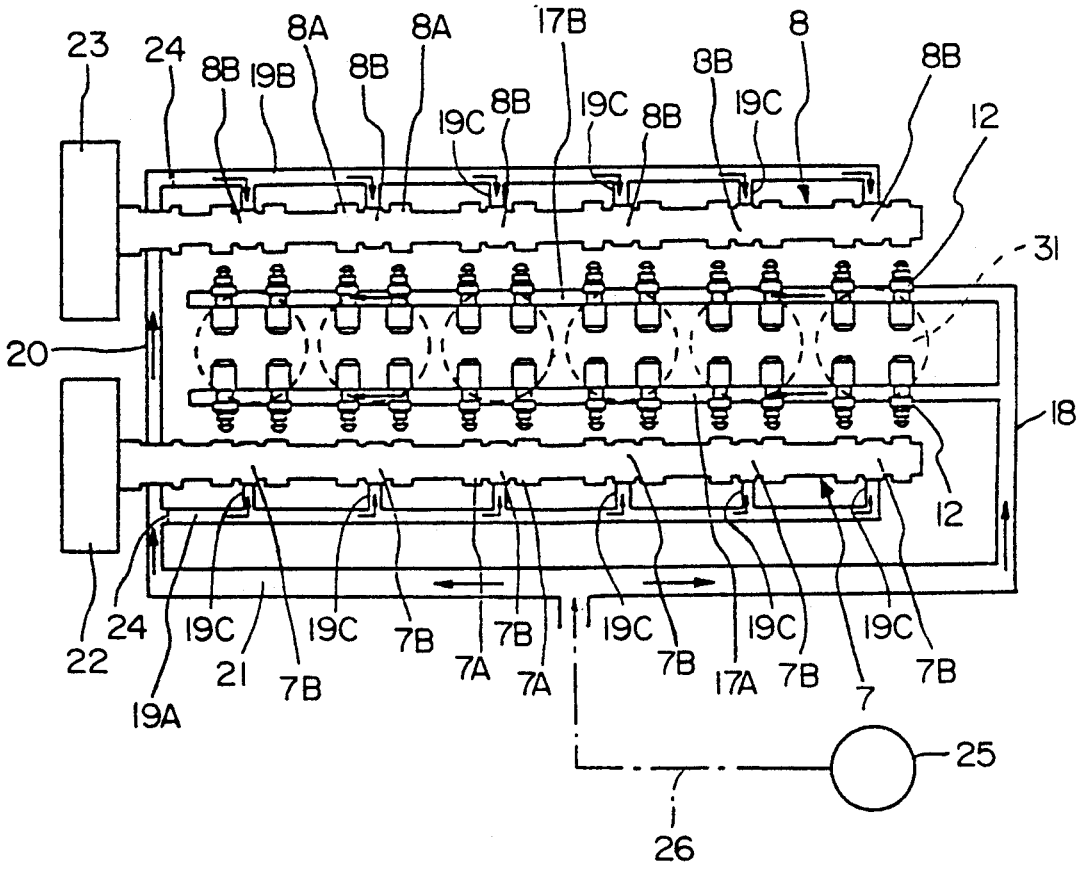
FIG. 5 is a diagrammatical illustration showing an oil line of the lubrication system of the in-line six cylinder internal combustion engine of FIG. 1.

The cylinder head 1 is provided with oil galleries forming part of a lubrication system. Referring to FIGS. 2 to 5, the cylinder head 1 is formed with a main oil gallery 21, drilled substantially throughout the full length of the cylinder head in a lower wall section AC thereof. The main oil gallery 21, after being drilled, is closed at both ends by plugs. Lubrication oil is introduced in the main oil gallery 21, under pressure from an oil pump 25 through a tube 26 (see FIG. 5). At one end remote from the front end of the cylinder head 1, where the pulleys 22 and 23 are secured to the ends of the part of the intake and exhaust camshafts 7 and 8, respectively, the main oil gallery 21 is connected to adjoining lash adjuster oil galleries 17A and 17B, also forming part of the lubrication system, by a connecting oil passageway 18 (see FIGS. 2, 4 and 5) extending upwardly from the main oil gallery 21 in the cylinder head 1. Each lash adjuster oil gallery 17A or 17B is drilled substantially through the full length of the cylinder head 1 and, after being drilled, is closed at both ends by plugs 17. The lash adjuster oil galleries 17A and 17B extend along the respective rows of the hydraulic valve lash adjusters 10 and are in communication with the hydraulic chambers of the respective valve lash adjusters 19 so as to apply the pressurized oil into the hydraulic chamber of each valve lash adjuster 19. At the opposite end of the main oil gallery 21, close to the front end of the cylinder head 1, the main oil gallery 21 is further connected to adjoining camshaft journal oil galleries 19A and 19B, located below the adjoining lash adjuster oil galleries 17A and 17B, respectively, and also forming part of the lubrication system, by a connecting oil passageway 20 (see FIGS. 3, 4 and 5) extending upwardly from the main oil gallery 21 in the cylinder head 1. Each camshaft journal oil gallery 19A or 19B is drilled or otherwise formed substantially through the full length of the cylinder head 1 and, after being drilled, is closed at both ends by plugs 19. The camshaft journal oil galleries 19A and 19B have oil gallery extensions 19C. Each oil gallery extension 19C is drilled to open to each camshaft journal 7B or 8B to allow the pressurized oil to be carried to the camshaft journal 7B or 8B for lubrication. As is shown in FIG. 3 or 5, each of the camshaft journal oil galleries 19A and 19B is provided with an orifice 24 disposed adjacent to an opening of the connecting oil passageway 20 into the camshaft journal oil gallery for regulating the flow of pressurized oil. In place of these orifices 24 disposed in the camshaft journal oil galleries 19A and 19B, respectively, a single orifice could be disposed in the main oil gallery 21 just before the connecting oil passageway 20.

Figure 6:
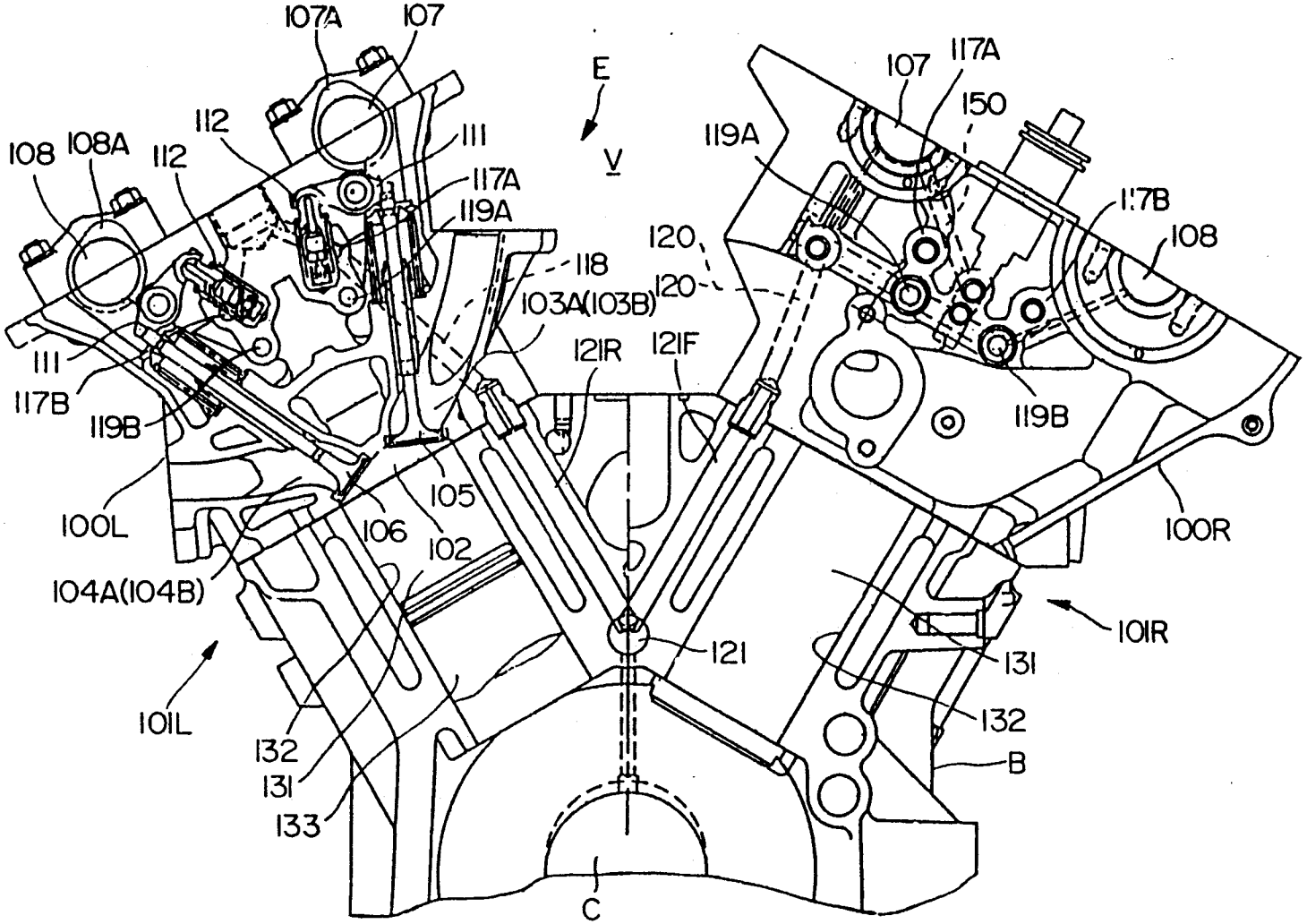
FIG. 6 is a schematic cross-sectional view showing a V-12 internal combustion engine with a lubrication system according to a preferred embodiment of the present invention.
Figure 7:
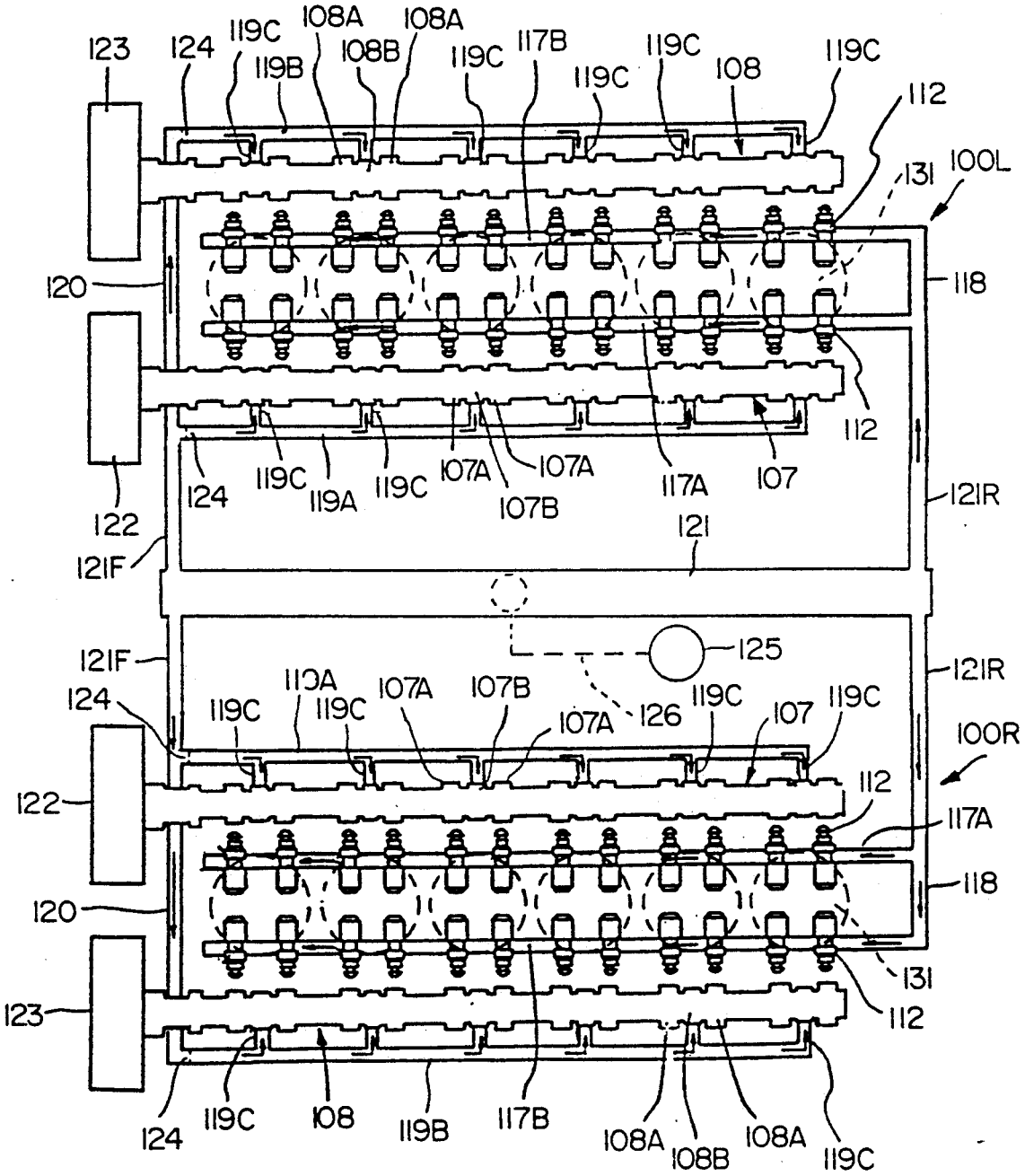
FIG. 7 is a diagrammatical illustration showing an oil line of the lubrication system of the V-12 internal combustion engine of FIG. 6.

Referring to FIGS. 6 and 7, there is illustrated a V-12 double overhead camshaft engine including a lubrication system constructed in accordance with another preferred embodiment of the present invention. An engine body E consists of left and right cylinder banks 101L and 101R arranged in a V-formation, with a predetermined relative angle of, for instance, 60 degrees therebetween. Each cylinder bank 101L or 101R is formed with six cylinders 131. The cylinders 131 are divided into two groups and the cylinders 131 in each group are disposed in one and the same cylinder bank 101L or 101R, respectively, so that adjoining cylinders in each cylinder bank 101L or 101R do not fire one after another. The cylinder banks 101L and 101R are, respectively, provided with two intake ports 103A and 103B with openings which extend to the sides of the corresponding cylinder banks remote from a V-shaped space V between the cylinder banks 101L and 101R. Further, the cylinder 131 are, respectively, provided with two exhaust ports 104A and 104B with openings which extend toward the V-shaped space V. The cylinders 131 in the left cylinder bank 101L and the cylinders 131 in the right cylinder bank 101R are arranged in rows parallel to a crankshaft C, respectively.

The engine E has a cylinder block B provided with cylinder bores 132 in which pistons 133 can slide. A left cylinder head 100L is mounted on the cylinder block B and provides for the left cylinder bank 101L, and a right cylinder head 100R is mounted on the cylinder block 106 and provides for the right cylinder bank 101R. Combustion chambers 102 are formed in the cylinders 131, respectively, by the tops of the pistons 133, a lower wall of the cylinder heads 100L or 100R, and the cylinder bores 132. The intake ports 103A and 103B and the exhaust ports 104A and 104B open into each combustion chamber 102, and are opened and shut at a predetermined timing by intake valves 105 and exhaust valves 106, respectively.

An intake camshaft 107 and an exhaust camshaft 108 are mounted over each of the left and right cylinder heads 100L and 100R. The intake camshaft 107 and the exhaust camshaft 108 are in juxtaposition over the cylinder heads 100L or 100R, respectively. The intake camshaft 107 is provided with one cam or camshaft lobe 107A thereon for each intake valve 105 and has an end portion projecting out of the cylinder head 100L or 100R. Similarly, the exhaust camshaft 108 is provided with one cam or camshaft lobe 108A thereon for each exhaust valve 106 and has an end portion projecting out of the cylinder head 100L or 100R. Pulleys 122 and 123 (see FIG. 7) are, respectively, coaxially fixed on the ends of the parts of the intake and exhaust camshafts 107 and 108 projecting from the cylinder heads 100L and 100R. These pulleys 122 and 123 are connected or coupled to the crankshaft 105 by a timing belt or chain (not shown) which transmits the engine output to drive the camshafts 107 and 108 in synchronism in the same direction.

The V-12 double overhead camshaft engine has a valve driving apparatus, built in each cylinder head 100L or 100R, which is the same in structure and operation as the valve driving apparatus 9 of the previous embodiment, except that the V-12 engine has 48 sets of rocker arms 111 and hydraulic valve lash adjusters 112.

The left and right cylinder heads 100L and 100R are provided with oil lines forming part of a lubrication system. Because the oil lines of the left and right cylinder heads 100L and 100R are the same in structure and function as each other, the following description is directed to the oil line of either one of the cylinder heads 100L and 100R only. The cylinder block 106 is formed with a main oil gallery 121, running lengthwise therein, drilled just below the bottom of the V-shaped space V. Oil is introduced under pressure to the main oil gallery 121 from an oil pump 125 through a tube 126. The main oil gallery 121 has a main oil gallery extension 121R drilled, in the cylinder block 106, near the rear end and extending upward toward the left cylinder head 108F to the top surface. The main oil gallery extension 121R is connected, at its top end, to a connecting oil passageway 118 drilled in a side wall section of the left cylinder head 100L and extending behind the hydraulic valve lash adjusters 112 located adjacent to the cylinder 131 at the end of the row. Adjoining lash adjuster oil galleries 117A and 117B, also forming part of the lubrication system, are connected to the main oil gallery 121 by way of the connecting oil passageway 118 communicating with the main oil gallery extension 121R. Each lash adjuster oil gallery 117A or 117B is drilled substantially throughout the full length of the left or right cylinder head 100L or 100R and, after being drilled, is closed at both ends by plugs. The lash adjuster oil galleries 117A and 117B extend along the respective rows of the hydraulic valve lash adjusters 112 and are in communication with the hydraulic chambers of the respective valve lash adjusters 118 so as to apply pressurized oil into the hydraulic chamber of each hydraulic valve lash adjuster 112. Identical oil galleries for the hydraulic valve lash adjusters 112 are provided for the left and right cylinder heads.

The oil gallery extension 121F is connected, at its top end, to a connecting oil passageway 120 drilled in a side wall section of the right cylinder head 100R and extending below the lash adjuster oil gallery 117A and 117B. Adjoining camshaft journal oil galleries 118A and 118B, also forming part of the lubrication system and extending below and in parallel with the adjoining lash adjuster oil galleries 117A and 117B, are connected to the main oil gallery 121 by way of the connecting oil passageway 120 communicating with the oil gallery extension 121F. Each camshaft journal oil gallery 119A or 119B is drilled substantially through the full length of the left or right cylinder head 100L or 100R and, after being drilled, is closed at both ends by plugs. The camshaft journal oil galleries 119A and 119B have oil gallery extensions 119C. Each oil gallery extension 119C drilled to open to each camshaft journal 108B or 107B to allow the pressurized oil to be carried to the camshaft journal 108B or 107B for lubrication. The same oil line as for the camshaft journal is provided for the left cylinder head 100L.

The main oil gallery 121 is provided with orifices 124 disposed for regulating the flow of pressurized oil.

In cooperation with the camshafts 5 and 6, the cylinder head 1 is provided with valve timing varying means, well known in structure and function to those skilled in the art, which varies opening and closing timing, and thus an overlap period of valve opening in accordance with engine operating conditions so as to improve the engine output property. To vary the valve timing, the built in valve timing varying means includes a rotation phase changing device itself for changing a rotation phase between the intake and exhaust camshafts 107 and 108. The rotation phase changing device is entirely conventional and is formed in the usual manner by a mechanism utilizing helical splines arranged between the driving pulleys connected with the crankshaft and the camshafts 107 and 108. This rotation phase changing device is operated by a hydraulic pressure applied by a hydraulic circuit through an oil gallery 150. The oil gallery 150 is drilled in each cylinder head 100L or 100R near the front end thereof. Each oil gallery 150 extends upwardly toward the top surface of its respective cylinder head 100L or 100R.

When a hydraulic pressure is applied through the oil gallery 150, the helical splines are caused to be oriented differently so as to effect a change in the rotation phase between the intake camshaft and exhaust camshaft 107 and 108, thereby varying the valve timing.

Because of the above arrangement of the lubrication oil line, the camshaft is supplied with a sufficient oil pressure at its journals close to the camshaft pulley, and a change of oil pressure in the camshaft journal oil gallery is prevented from adversely affecting the oil flow in the lash adjuster oil gallery, so as to provide each hydraulic valve lash adjuster with a sufficient oil pressure and a high reliability.

Furthermore, because both the lash adjuster oil gallery and the camshaft journal oil gallery are formed in a wall of the cylinder head where the hydraulic valve lash adjusters are installed, the structural rigidity of the wall portion and, therefore, of the whole structure of the cylinder head is improved.

It is to be understood that although the invention has been described in detail with respect to preferred embodiments thereof, nevertheless, various other embodiments and variants are possible which are within the spirit and scope of the invention, and such embodiments and variants are intended to be included in the invention as defined by the following claims.

What is claimed is:

1. A lubrication system for a multi-cylinder engine having a valve drive mechanism including a plurality of hydraulic valve lash adjusters arranged in a row and installed in a cylinder head of an engine block of the engine and a camshaft with journals which is disposed over the cylinder head and is attached, at one end thereof, with a camshaft pulley coupled to a crankshaft pulley by a belt, said lubrication system comprising:

a lash adjuster oil gallery formed in said cylinder head and extending along said row of said hydraulic valve lash adjusters, said lash adjuster oil gallery carrying pressurized oil into a pressure chamber of each hydraulic valve lash adjuster;

a camshaft oil gallery formed in said cylinder head and extending parallel to said lash adjuster oil gallery for carrying pressurized oil to each camshaft journal; and a main oil gallery extending lengthwise in said engine block for supplying said pressurized oil into both said lash adjuster oil gallery and said camshaft oil gallery, said main oil gallery being connected independently to one end of said camshaft oil gallery adjacent said camshaft pulley and to said lash adjuster oil gallery.

2. A lubrication system as defined in claim 1, wherein said main oil gallery is connected to one end of said lash adjuster oil gallery at a location remote from said camshaft pulley.

3. A lubrication system as defined in claim 1, wherein said main oil gallery is connected to said lash adjuster oil gallery and said camshaft oil gallery by independent passageways formed in said engine block and branching off from said main oil gallery.

4. A lubrication system as defined in claim 3, wherein said independent passageways branch off from opposite ends of said main oil gallery.

5. A lubrication system as defined in claim 4, wherein said main oil gallery is formed in said cylinder head.

6. A lubrication system as defined in claim 4, wherein said main oil gallery is formed in a cylinder block of said engine block.

7. A lubrication system as defined in claim 1, further comprising pressure regulating means disposed before said camshaft oil gallery.

8. A lubrication system as defined in claim 7, wherein said pressure regulating means is an orifice.

9. A lubrication system as defined in claim 1, further comprising valve timing varying means including an oil gallery branching off from said camshaft oil gallery.

* * * * *